United States Patent [19]

Stearley et al.

[11] 4,150,268

[45] * Apr. 17, 1979

[54] PRESSURE OPERATED SWITCH CONSTRUCTION HAVING A ONE-PIECE CONTROL SHAFT BRACKET STRUCTURE

[75] Inventors: John W. Stearley, Indiana, Pa.; Paul M. Rowley, Bexley, Ohio; Thomas M. Buckshaw, Indiana, Pa.

[73] Assignee: Robertshaw Controls Company, Richmond, Va.

[ * ] Notice: The portion of the term of this patent subsequent to Feb. 14, 1995, has been disclaimed.

[21] Appl. No.: 869,035

[22] Filed: Jan. 13, 1978

Related U.S. Application Data

[63] Continuation of Ser. No. 697,707, Jun. 21, 1976, Pat. No. 4,081,637.

[51] Int. Cl.[2] ..... H01H 35/34

[52] U.S. Cl. ..... 200/83 R; 200/83 P; 200/83 WM

[58] Field of Search ..... 200/83 P, 83 S, 83 R, 200/83 WM; 285/DIG. 22; 403/119, 151, 152, 161; 308/238

[56] References Cited

U.S. PATENT DOCUMENTS

| | | | |
|---|---|---|---|
| 2,636,093 | 4/1953 | Clark | 200/83 P |
| 3,237,646 | 3/1966 | Houser | 200/83 P |
| 3,798,400 | 3/1974 | Gebel | 200/83 WM |
| 4,081,637 | 3/1978 | Stearley | 200/83 WM |

FOREIGN PATENT DOCUMENTS

| | | | |
|---|---|---|---|
| 1341027 | 9/1963 | France | 200/83 P |

*Primary Examiner*—Gerald P. Tolin
*Attorney, Agent, or Firm*—Candor, Candor & Tassone

[57] ABSTRACT

A pressure operated switch construction having a base carrying a pressure operated diaphragm and an electrical switch unit controlled by the diaphragm and an adjustable compression spring controlled by a cam operated actuator leaf pivotally carried by the base. The base has integral bracket members extending therefrom, each bracket member having an integral snap-in arrangement. A cam shaft unit is snapped into the snap-in arrangement of the bracket members to be rotatably carried thereby, the cam shaft unit having a cam for operating on the actuator leaf to position the same.

5 Claims, 14 Drawing Figures

PRESSURE OPERATED SWITCH CONSTRUCTION HAVING A ONE-PIECE CONTROL SHAFT BRACKET STRUCTURE

This application is a continuation application of parent patent application Ser. No. 697,707, filed June 21, 1976, now U.S. Pat. No. 4,081,637.

This invention relates to an improved pressure operated switch construction and method of making the same.

It is well known that pressure operated switch constructions have been provided wherein each has a base carrying a pressure operated diaphragm and electrical switch unit controlled by the diaphragm and an adjustable compression spring that, in turn, is controlled by a cam operated actuator leaf pivotally carried by the base.

It is a feature of this invention to provide such a pressure operated switch construction with improved parts.

In particular, one embodiment of this invention provides such a pressure operated switch construction wherein the base has integral bracket members extending therefrom, each bracket member having integral snap means. A cam shaft unit is snapped into the snap means of the bracket members to be rotatably carried thereby, the cam shaft unit having a cam means for operating on the actuator leaf to position the same. The cam shaft unit can comprise a one-piece structure having a shaft member integral with the cam means thereof. One of the bracket members can have means pivotally mounting the actuator leaf to the base. The pressure operated switch construction includes a case and clip means can be utilized to secure the case to the base whereby the diaphragm is held between the case and base. The case can comprise a one-piece structure and have an integral eyelet extending therefrom with the eyelet being provided with an integral orifice, if desired. The switch unit can have three terminals projecting through three openings provided in the base, the terminals being adapted to be disposed in aligned relation, if desired. The one-piece base structure, the one-piece cam shaft unit and the one-piece case can each be molded from plastic material, if desired.

Accordingly, it is an object of this invention to provide an improved pressure operated switch construction having one or more of the novel features set forth above or hereinafter shown or described.

Another object of this invention is to provide a method of making such a pressure operated switch construction, the method of this invention having one or more of the novel features set forth above or hereinafter shown or described.

Other objects, uses and advantages of this invention are apparent from a reading of this description which proceeds with reference to the accompanying drawings forming a part thereof and wherein.

Figure 1:
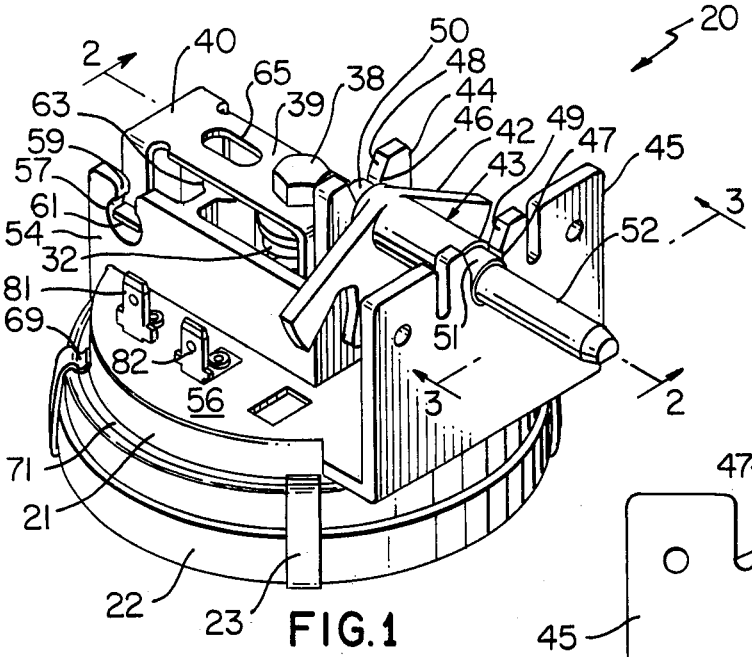
FIG. 1 is a top perspective view of the improved pressure operated switch construction of this invention.

While the various features of this invention are hereinafter described and illustrated as being particularly adapted to provide a water level pressure operated switch construction, it is to be understood that the various features of this invention can be utilized singly or in any combination thereof to provide a pressure operated switch for other purposes.

Therefore, this invention is not to be limited to only the embodiments illustrated in the drawings, because the drawings are merely utilized to illustrate one of the wide variety of uses of this invention.

Figure 3:
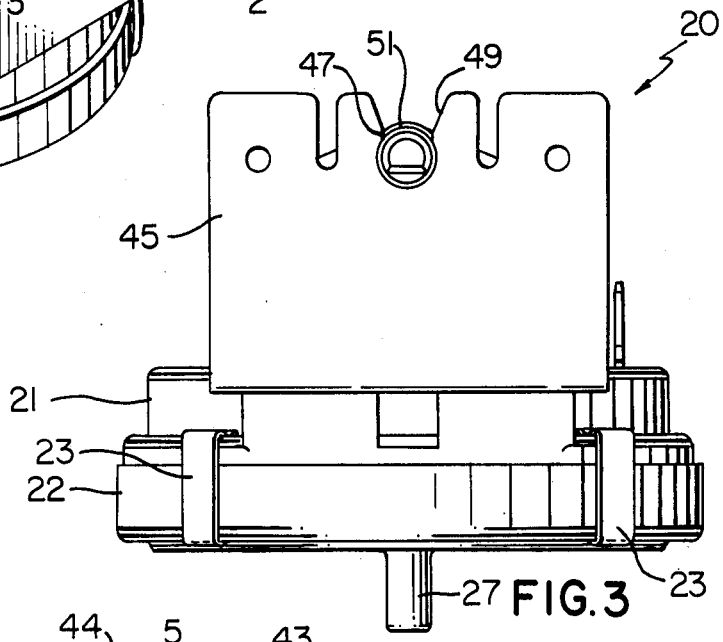
FIG. 3 is an end view of the pressure switch construction of FIG. 1 and is taken substantially in the direction of the arrows 3—3 of FIG. 1.
Figure 2:
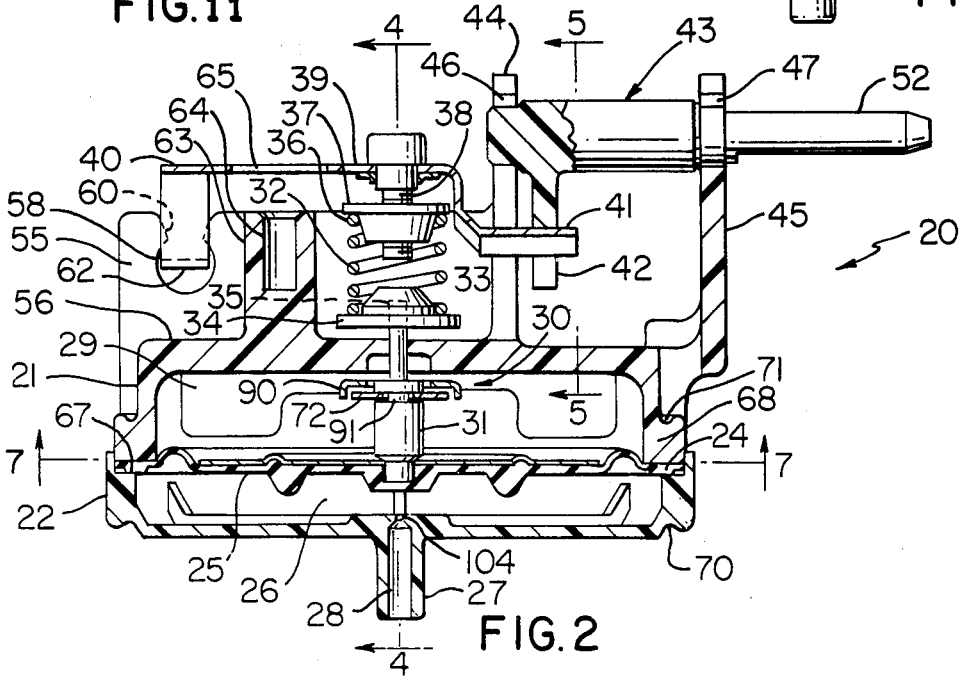
FIG. 2 is a cross-sectional view taken on line 2—2 of FIG. 1.

Referring now to FIGS. 1-3, the improved pressure operated switch construction of this invention is generally indicated by the reference numeral 20 and comprises a one-piece base 21 secured to a one-piece case 22 by spring clips 23 in a manner hereinafter described to trap an outer peripheral means 24 of a flexible diaphragm 25 therebetween so that the diaphragm 25 cooperates with the case 22 to define a chamber 26 therebetween to be responsive to fluid pressure conveyed thereto by an eyelet extension 27 of the case 22 having a passage means 28 therein.

The diaphragm 25 cooperates with the base 21 to define a chamber 29 therebetween which contains a switch unit of this invention that is generally indicated by the reference numeral 30 and will be hereinafter described, the flexible diaphragm 25 controlling the switch unit 30 by means of a plunger 31 that acts on the switch unit 30 and is operatively interconnected to a compression spring 32 that also controls the operation of the switch unit 30 through the plunger 31 in a manner hereinafter described.

The compression spring 32 has one end 33 thereof bearing against a spring retainer 34 carried on the upper end 35 of the plunger 31 and the other end 36 thereof bearing against a spring retainer 37 threadedly disposed on a threaded adjusting member 38 carried by an actuator leaf 39 having one end 40 pivotally mounted to the base 21 in a manner hereinafter described and another end or tip 41 positioned by a cam means 42 on a cam and shaft unit of this invention that is generally indicated by the reference numeral 43 and is rotatably carried by the base 21 in a manner now to be described.

The base 21 can be molded from plastic material, such as polypropylene, as a one-piece structure having integral therewith a pair of outwardly extending bracket members 44 and 45 respectively having snap-in slot means 46 and 47 formed therein and being substantially circular in cross-section while triangularly shaped lead in parts 48 and 49 of the slot means 46 and 47 intersects therewith so that opposed cylindrical bearing parts 50 and 51 of a shaft means 52 of the shaft and cam unit 43 can be respectively snapped into the circular snap in parts 46 and 47 of the bracket members 44 and 45 to rotatably mount the cam shaft unit 43 to the base 21 without the need for additional mounting means as in prior known pressure switch constructions.

Figure 5:
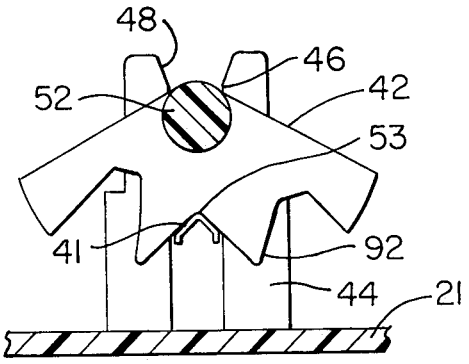
FIG. 5 is a cross-sectional view taken on line 5—5 of FIG. 2.

The cam shaft unit 43 of this invention is a one-piece structure that is molded from plastic material, such as the aforementioned polypropylene, and has the cam 42 integral with the cam shaft 52 and being formed into the configuration illustrated in FIG. 5 so that the valleys 53 thereof will properly position the end or tip 41 of the actuator leaf 39 for the desired setting of the pressure operated switch construction 20 in a manner well known in the art.

By having the cam shaft unit 43 "snapped" into the bracket members 44 and 45 of the base 21, the need for a retaining clip to hold the cam shaft unit 43 in place is eliminated by this invention. Further, since the molded parts are self lubricating, there is no need to grease the cam 42, actuator tip 41, and the slotted portions 46 and 47 of the bracket members 44 and 45 as in prior known pressure operated switch constructions.

The bracket member 44 of the base 21 has a pair of integral extensions 54 and 55 extending therefrom and extending upwardly from the top 56 of the base 21, the side members 54 and 55 respectively having circular slots 57 and 58 passing therethrough and being intersected by lead in slot parts 59 and 60 so that a pair of outwardly directed tangs 61 and 62 on the actuator leaf 39 can be respectively received in the circular parts 57 and 58 of the side members 54 and 55 to pivotally mount the end 40 of the actuator leaf 39 to the base 21 as fully illustrated in FIGS. 1 and 2.

Figure 10:
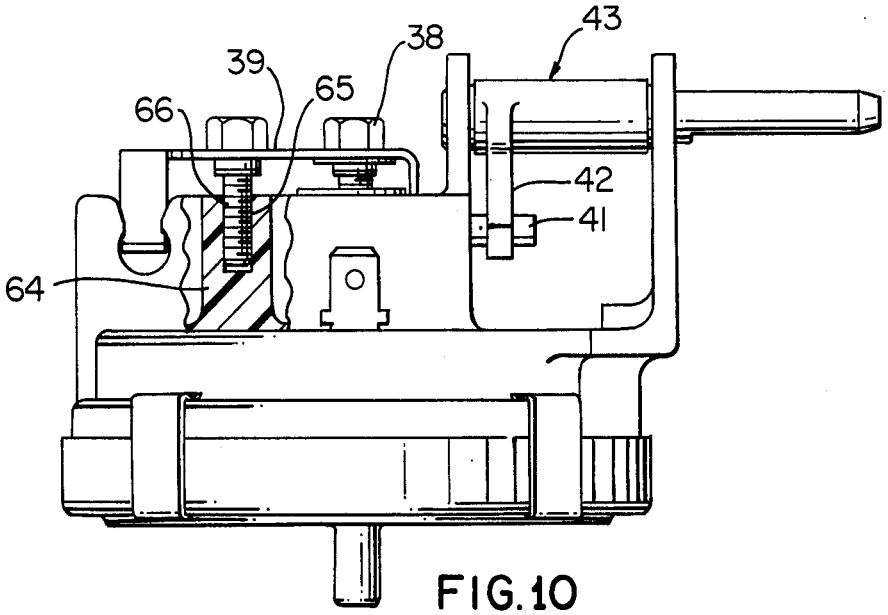
FIG. 10 is a view similar to FIG. 2 except in elevation and illustrates an adjustment feature thereof.

The side members 54 and 55 of the bracket member 44 are respectively interconnected to an integral central section 63 of the base 21 having an opening 64 passing therethrough and aligned with a slot 65 in the actuator leaf 39 so that a threaded adjusting member 66, FIG. 10, can pass through the slot 65 in the actuator leaf 39 and be threadedly received in the opening 64 of the center section 63 for adjustment purposes, if desired. For example, the adjusting member 66 provides an extra calibration feature for the pressure operated switch construction 20 of this invention at the lowest setting thereof. This is accomplished by having the low portion of the cam 42 relived so that the actuator leaf end or tip 41 is not influenced by the low cam position so that the low calibration setting adjustment is achieved by the adjusting screw 66 that moves the actuator tip 41 up or down as required to meet the desired setting.

The case 22 has a stepped open end 67 which not only receives the outer peripheral part 24 of the flexible diaphgram 25, but the same also receives an open end 68 of the base 21 in an overlapping manner whereby the C-shaped spring clips 23 are adapted to pass around the telescoping open ends 67 and 68 of the case 22 and base 21 to have inwardly bend ends 69 thereof respectively received in annular grooves 70 and 71 of the case 22 and base 21 as illustrated.

In this manner, the bases 21 and cases 22 of the switch constructions 20 of this invention can be readily opened and salvaged by merely removing the spring clips 23. Thus, special tools are not required for this disassembly and this disassembly can take place without damaging the various parts of the pressure operated switch constructions 20 of this invention.

Figure 4:
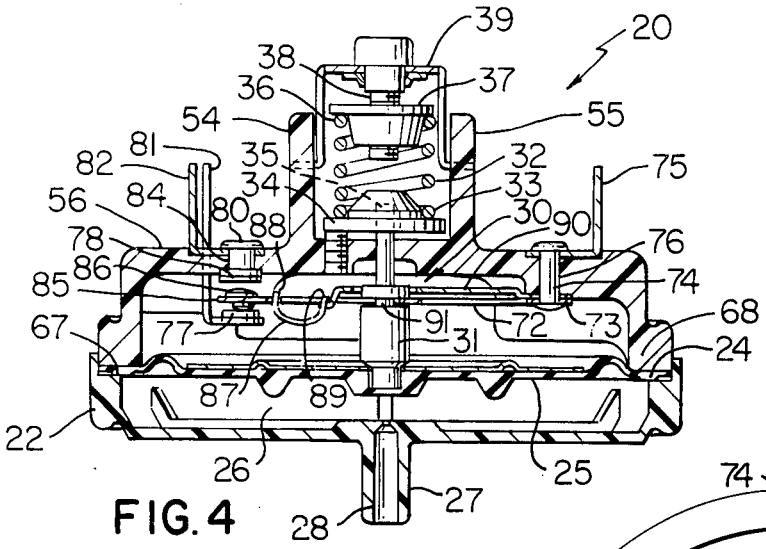
FIG. 4 is a cross-sectional view taken on line 4—4 of FIG. 2.
Figure 7:
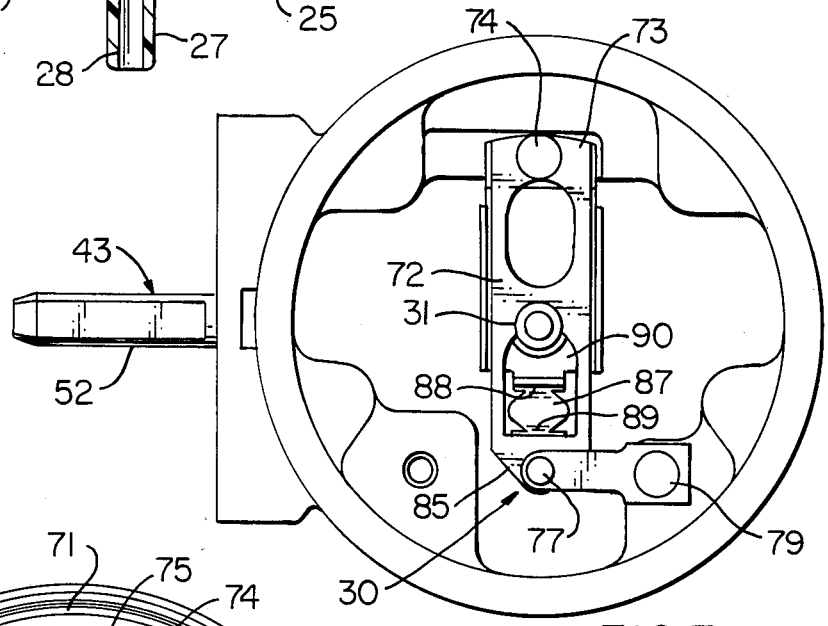
FIG. 7 is a cross-sectional view taken on line 7—7 of FIG. 2 and is turned 180°.

The switch unit 30 of the pressure operated switch construction 20 is best illustrated in FIGS. 4 and 7 and the same comprises a snap switch blade 72 having one end 73 fastened to the base 21 by a rivet 74 which can also interconnect a terminal 75 thereto so that the rivet 74 and terminal 75 project out through an opening 76 of the base 21 for external electrical interconnection to the switch blade 72. Likewise, a pair of fixed spaced contacts 77 and 78 of the switch unit 30 are disposed in the chamber 29 of the switch construction 20 and are secured in place by rivets 79 and 80 that are also adapted to secure external terminals 81 and 82 to the case 21 whereby the terminal 81 projects out through an opening 83 in the case base 21 while the terminal 82 is external to the base 21 so that the rivet 80 extends out through an opening 84 in the base 21.

Thus, it can be seen that external electrical connections can be provided by the terminals 81 and 82 respectively to the fixed contacts 77 and 78 of the switch unit 30.

The switch blade 72 has its free end 85 provided with contact means 86 that is adapted to be snapped between the fixed contacts 77 and 78 depending upon the position of a rolling spring 87 having one end 88 interconnected to the switch blade 72 and the other end 89 interconnected to a fixed blade 90 also secured to the base 21 by the rivet 74 as illustrated in FIG. 4.

The plunger 31 has a reduced part 91 that receives part of the switch blade 72 therein so that up and down movement of the plunger 31 causes the switch blade 72 to move up or down and thereby cause the end 85 of the switch blade 72 to snap between the fixed contacts 77 and 78 by the action of the rolling spring 87 in a manner well known in the art.

Thus, as the flexible diaphragm 25 in FIG. 4 is moved upwardly by the pressure increasing in the chamber 26 so that the plunger 31 is moved upwardly in opposition to the force of the compression spring 32, at a certain point in such upward movement of the plunger 31, the rolling spring 87 causes the switch blade 72 to snap over center and move the end 85 upwardly so that the contact 86 thereof is moved away from the lower fixed contact 77 and is placed into contact with the upper fixed contact 78. In order to reset the switch unit 30, the cam shaft unit 43 is rotated so that an extension 92 on the cam 42 will operate on the tip 41 of the actuator leaf 39 and move the same downwardly and through the force of the compression spring 32 will move the plunger 31 downwardly and thereby cause the switch blade 72 to snap over center and move the movable contact 86 thereof downwardly away from the upper fixed contact 78 and back into contact with the lower fixed contact 77 as illustrated in FIG. 4 and in a manner well known in the art.

If desired, the cam shaft unit 43 can be provided with an infinite adjustable cam rather than the stepped cam 42 illustrated in FIG. 5.

Figure 13:
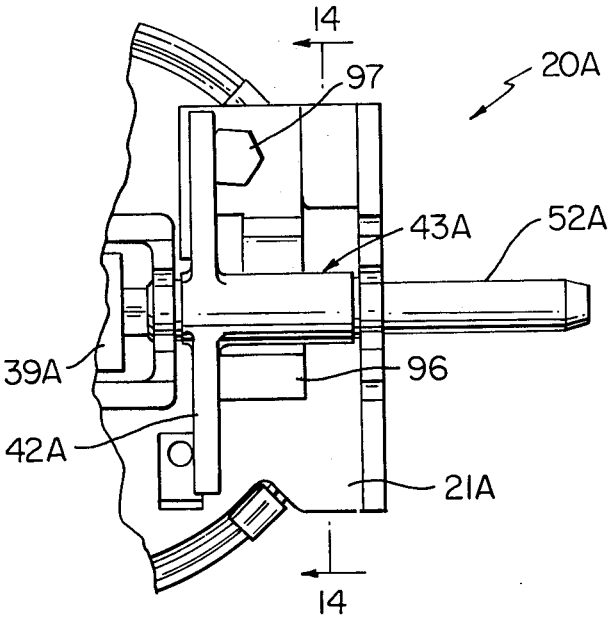
FIG. 13 is a fragmentary view similar to FIG. 6 and illustrates the switch construction with an infinite cam means therefor.
Figure 14:
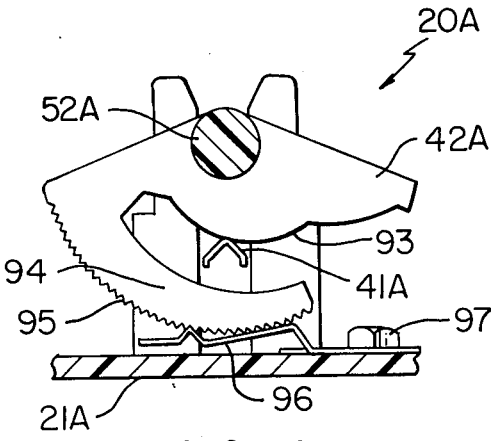
FIG. 14 is a cross-sectional view taken on line 14—14 of FIG. 13.

For example, reference is now made to FIG. 13 and 14 wherein another pressure operated switch construction of this invention is generally indicated by the reference numeral 20A and parts thereof similar to the switch construction 20 previously described are indicated by like reference numerals followed by the reference letter "A".

As illustrated in FIGS. 13 and 14, the switch construction 20A is substantially identical to the switch construction 20 previously described except that the cam shaft unit 43A has an infinite cam 42A provided with an arcuate surface 93 for operating on the tip 41A of the actuator leaf 39A in an infinite manner during rotation of the cam shaft 52A. In addition, the cam 42A has an arcuate extension 94 provided with a serated edge 95 that cooperates with a leaf detent 96 secured to the base 21A by a fastening means 97 to hold the cam 42A in the selected rotational position thereof in a manner similar to ratchet and gear arrangement.

Figure 6:
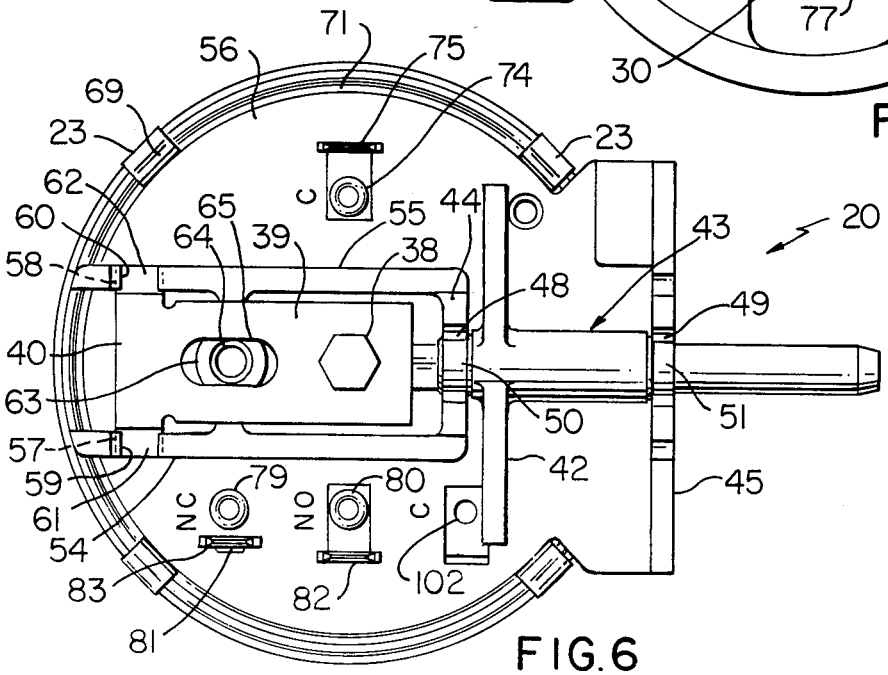
FIG. 6 is a top view of the pressure operated switch construction of FIG. 1.

While the common terminal 75 for the switch blade 72 of the switch unit 30 is illustrated in FIGS. 1, 4 and 6 as being on the side of the base 21 opposite from the terminals 81 and 82, it is to be understood that the common terminal 75 can be located on the same side of the base 21 as the terminals 81 and 82 so as to be in aligned relation therewith, if desired.

Figure 8:
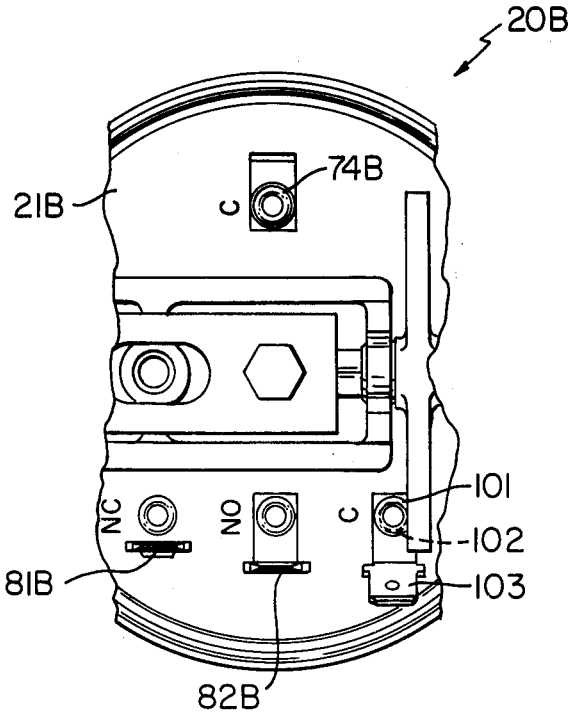
FIG. 8 is a fragmentary view similar to FIG. 6 and illustrates the switch construction of this invention when the terminals thereof are disposed in aligned relation.
Figure 9:
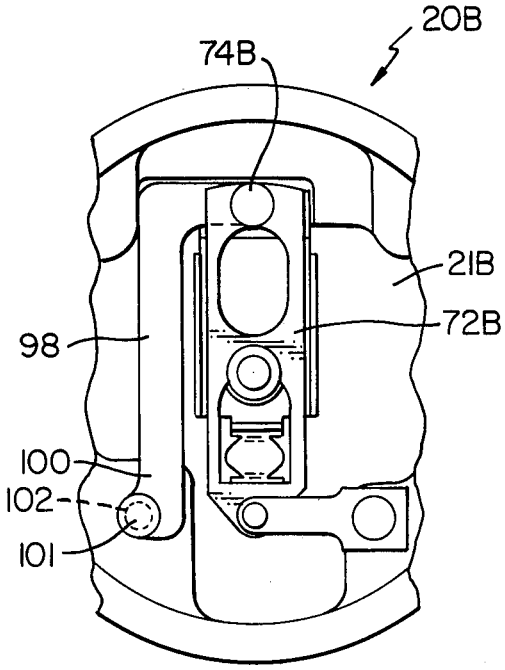
FIG. 9 is a fragmentary view similar to FIG. 7 and illustrates the switch structure when the terminals are disposed in aligned relation as illustrated in FIG. 8.

For example, reference is now made to FIGS. 8 and 9 wherein another switch construction of this invention is generally indicated by the reference numeral 20B and parts thereof similar to the switch construction 20 previously described are indicated by like reference numerals followed by the reference letter "B".

As illustrated in FIGS. 8 and 9, an internal conductor 98 has one end 99 secured to the base 21 by the rivet 74B while the other end 100 thereof is secured to the base 21 by another rivet 101 that passes through an opening 102 in the base 21B and fastens an external terminal 103 to the base 21B as illustrated in FIG. 8 so that external lead connection can be made to the switch blade 72B through the terminal 103 rather than through the terminal 75 at the rivet 74 in the switch construction 20 as previously described. Thus, all terminals for the switch construction 20B can be located on the same side of the base 21B and in aligned relation as illustrated in FIG. 8.

The case 22 of the various switch constructions 20, 20A and 20B of this invention can also be molded as a one-piece structure from plastic material, such as the aforementioned polypropolene, whereby the eyelet 27 is integral therewith. As illustrated in FIG. 2, the eyelet 27 includes an integral orifice 104 that has been molded in the case 22 as illustrated.

Figure 11:
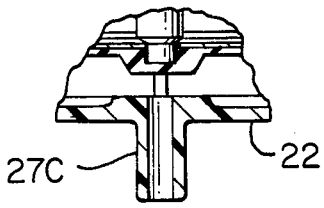
FIG. 11 is a fragmentary view illustrating another embodiment of the eyelet of the case of the switch construction of FIG. 2.
Figure 12:
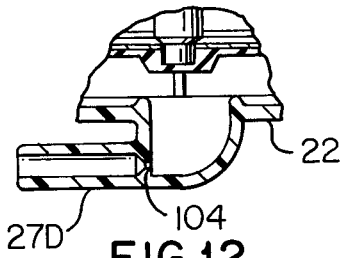
FIG. 12 is a view similar to FIG. 11 and illustrates another embodiment of the eyelet structure.

However, if it is desired not to have an orifice 104 in the eyelet 27, the case 22 can be readily molded without such eyelet as fully illustrated by the reference 27C in FIG. 11. Also, the case 22 can have the eyelet 27 thereof disposed at an angle relative thereto with or without an orifice 104 as fully illustrated in FIG. 12 wherein the angled eyelet is indicated by the reference numeral 27D.

Therefore, it can be seen that the various pressure operated switch constructions 20, of this invention can be formed from a plurality of molded parts to contain the diaphragm 25 and switch unit 30 to be operated on by the diaphragm 25 and the compression spring 32 in the manner previously described the base 21 and case 22 readily being secured together by the clips 23 and the actuator leaf 39 being readily assembled to the side members 54 and 55 to be pivotally mounted thereto. The cam shaft unit 43 is also adapted to be readily snap fitted into the snap means 46 and 47 of the bracket members 44 and 45 in the manner previously described.

Thus, it can be seen that fewer parts are required for the switch construction 20 of this invention than conventional pressure operated switch constructions some of which have as many as ten more parts than the pressure operated switch construction 20 of this invention.

Accordingly, it can be seen that the switch construction 20 of this invention has a one-piece molded plastic cam shaft unit 43. The prior known mounting brackets and base have been combined as a one-piece molded plastic part 21. The cam shaft unit 43 is snapped into the integral bracket members 44 and 45 and thereby eliminates the need for a retaining clip to hold it in place. The molded parts are self lubricating and thereby eliminates the need to grease the cam 42, actuator tip 41 and the slotted portions 46 and 47 of the mounting brackets 44 and 45. The base 2 is molded from resilient plastic material and in addition to allowing the cam shaft unit 43 to be snapped in place, the resilient material is believed to reduce breakage from handling and during the riveting operations thereon. The actuator leaf 39 is adapted to be assembled to the base 21 in a manner that eliminates the need for a drilling and pinning operation so that the convention knurled pin is not required. The design of the switch unit 30 permits locating all three terminals in the same area as illustrated in FIGS. 8 and 9 or the common terminal 75 can be positioned away from the normally opened and normally closed terminals 81 and 82 as fully illustrated in FIG. 6. If desired, the terminal designations can be included in the mold of the base 21 as illustrated in FIGS. 6 and 8 thereby eliminating the need for an ink stamping operation. A conventional contact arm has been eliminated and the same is now incorporated as part of the normally closed terminal 81. The case 22, eyelet 27, and orifice 104 (when required) have been combined into a one-piece molded part. This case arrangement is adapted to be assembled with the mounting clips 23 to permit case salvage if reoperation is required. Further, the case 22, cam shaft unit 43 and actuator leaf 39 have been designed for ease of assembly and disassembly without special tools or without damaging any parts thereof. The actuator leaf 39 is a "fixed probe" design which minimizes manual reset problems that can occur when different cam positions are selected. An extra calibration feature is also available with this structure, the extra calibration feature being for the lowest setting. This is accomplished by having the low portion of the cam relieved so that the actuator tip 41 is not influenced by the low cam position. The low calibration adjustment is achieved by adjusting the calibration screw 66 that moves the actuator tip 41 up or down as required to meet the desired setting. In addition to the elimination of several parts by the switch construction 20 of this invention, the switch construction 20 also eliminates the need for plating operations on various parts of that are now molded and the soldering and/or welding operation of the eyelet to the case has been eliminated due to the one-piece molded part or case 22 of this invention.

Therefore, it can be seen that this invention not only provides an improved pressure operated switch construction, but also this invention provides improved method of making the same.

While the forms and methods of this invention now preferred have been illustrated and described as required by the Patent Statute, it is to be understood that other forms and method steps can be utilized and still fall within the scope of the appended claims.

What is claimed is:

1. In a pressure operated switch construction having a base carrying a pressure operated diaphragm and an electrical switch unit controlled by said diaphragm and an adjustable compression spring controlled by a cam operated actuator leaf pivotally carried by said base, the improvement wherein said base includes a one-piece plastic structure of a plurality of bracket members extending therefrom, said bracket members each having integral snap means, and a cam shaft unit snapped into said snap means of said bracket members to be rotatably carried thereby, said cam shaft unit having a cam means for operating on said actuator leaf to position the same, said cam shaft unit also being a one-piece plastic structure.

2. A pressure operated switch construction as set forth in claim 1 wherein said snap means each comprises a snap slot provided in a respective bracket member.

3. A pressure operated switch construction as set forth in claim 2 wherein said snap slots are disposed in aligned relation.

4. A pressure operated switch construction as set forth in claim 1 wherein one of said bracket members has means pivotally mounting said actuator leaf to said base.

5. A pressure operated switch construction as set forth in claim 4 wherein said means for pivotally mounting said actuator leaf to said base comprises a pair of spaced slots in said one bracket member, said leaf having a pair of opposed tangs respectively received in said slots.

* * * * *